US006056515A

United States Patent [19]

Cuneo

[11] Patent Number: 6,056,515

[45] Date of Patent: May 2, 2000

[54] HYDROCLEANING MACHINE WITH PUMP MOUNTING CLOSURE LID

[75] Inventor: Carlo Alberto Cuneo, Crema, Italy

[73] Assignee: Officine Meccaniche F.A.I.P. S.r.l., Italy

[21] Appl. No.: 08/691,867

[22] Filed: Aug. 2, 1996

[30] Foreign Application Priority Data

Jul. 4, 1996 [IT] Italy ..... MI96A1372

[51] Int. Cl.[7] ..... F04B 1/12

[52] U.S. Cl. ..... 417/271; 417/360

[58] Field of Search ..... 417/269, 271, 417/360

[56] References Cited

U.S. PATENT DOCUMENTS

| | | | |
|---|---|---|---|
| 1,996,789 | 4/1935 | Baker | 417/271 |
| 2,481,441 | 9/1949 | Parsons | 417/269 |
| 4,105,369 | 8/1978 | McClocklin | 417/269 |
| 4,776,260 | 10/1988 | Vincze | 417/269 |
| 5,415,077 | 5/1995 | Ono | 417/269 |
| 5,494,414 | 2/1996 | Steinhart et al. | 417/360 |

*Primary Examiner*—Timothy Thorpe
*Assistant Examiner*—Peter G. Korytnyk
*Attorney, Agent, or Firm*—Leydig, Voit & Mayer, Ltd.

[57] ABSTRACT

A vertically oriented hydrocleaning machine comprising a motor having a housing and a downwardly oriented vertical drive shaft, and an axial pump having a piston guide unit driven by the drive shaft. The motor housing includes a closure lid which defines a shaft support for the motor drive shaft, an annular bearing seat, and at least one reference surface for facilitating concentric aligned mounting of the piston guide on the motor, without the necessity for an intermediate mounting flange between the piston guide unit and motor. The illustrated motor closure lid further defines an oil sump chamber internally within the motor and a further annular seat within which a shaft sealing ring is disposed. The motor housing closure lid enables the piston guide unit to be quickly and precisely secured to the drive motor to produce a more compact and rigid high pressure washer.

23 Claims, 2 Drawing Sheets

HYDROCLEANING MACHINE WITH PUMP MOUNTING CLOSURE LID

FIELD OF THE INVENTION

The present invention relates generally to hydrocleaning machines, and more particularly, to hydrocleaning machines utilizing an axial piston pump driven by an internal combustion engine.

BACKGROUND OF THE INVENTION

Hydrocleaning machines use high pressure water jets for numerous cleaning purposes. Such hydrocleaning machines, commonly referred to as pressure washers, typically comprise a motor, generally of the internal combustion type, a pump/piston guide unit having reciprocating pistons driven by an oscillating plate fixed to the motor shaft, and an intermediate flange for connecting the piston guide unit to the motor which includes thrust and/or radial bearings for the motor shaft. Such hydrocleaning machines are relatively expensive to manufacture by virtue of the multiplicity of components and the sealing requirements for high pressure operation. Besides the need for the intermediate flange between the motor and piston guide unit, which markedly increases the size of the conventional pressure washers, special seals are required to avoid lubrication losses.

OBJECTS AND SUMMARY OF THE INVENTION

It is an object of the invention to provide a more compact and economical to manufacture hydrocleaning machine.

Another object is to provide a hydrocleaning machine as characterized above which eliminates the necessity for an intermediate mounting flange between the motor and piston pump unit. A related object is to provide such a hydrocleaning machine which eliminates the cost of manufacture of the intermediate flange, as well as the additional sealing requirements associated therewith.

A further object is to provide a hydrocleaning machine of the above kind in which the pump unit may be directly and compactly mounted to the motor.

Another object is to provide a hydrocleaning machine which enables more rigid and reliable mounting of the pump unit to the motor.

Yet another object is to provide a hydrocleaning machine of the foregoing type which facilitates precision mounting of the pump unit on the motor.

Another object is to provide such a hydrocleaning machine which is markedly reduced in size and weight.

These and other objects are achieved by a hydrocleaning machine in which the housing of the motor includes a closure lid which provides axial support for the motor shaft, which defines reference surfaces for accurate concentric assembly of the piston guide unit, and which is formed with integral seating surfaces for oil seals and thrust bearings.

Other objects and advantages of the invention will become apparent upon reading the following detailed description and upon reference to the drawings, in which.

Figure 1:
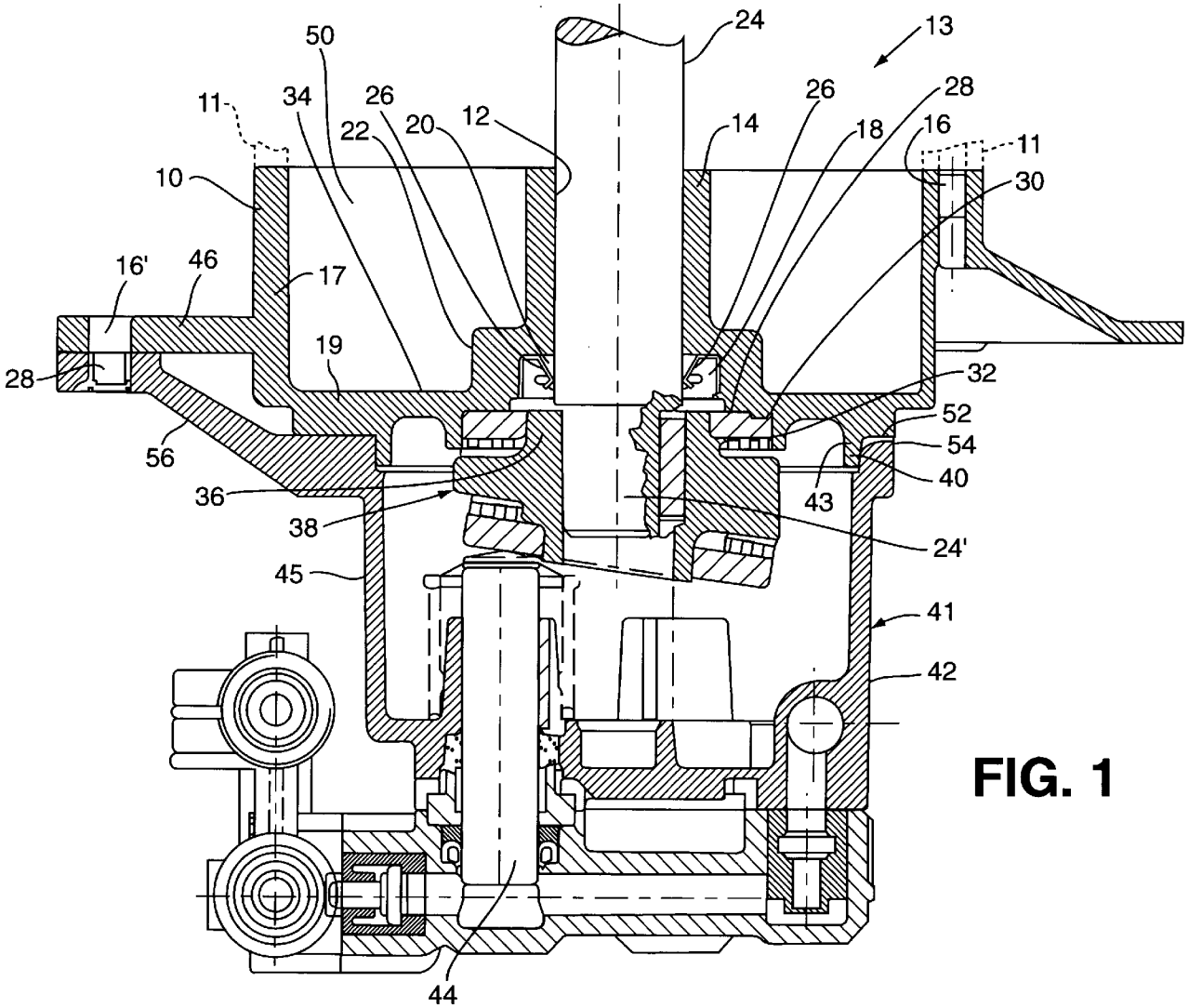
FIG. 1 is a vertical section of an illustrative hydrocleaning machine embodying the present invention.

While the invention is susceptible of various modifications and alternative constructions, certain illustrative embodiments thereof have been shown in the drawings and will be described below in detail. It should be understood, however, that there is no intention to limit the invention to the specific forms disclosed, but on the contrary, the intention is to cover all modifications, alternative constructions, and equivalents falling within the spirit and scope of the invention.

DETAILED DESCRIPTION OF THE PREFERRED EMBODIMENT

Referring now more particularly to FIG. 1 of the drawings, there is shown an illustrative hydrocleaning machine embodying the invention which comprises a motor 13 and pump 41 supported in depending relation to the motor. The motor, which typically may be an internal combustion type, has a housing 11 and a power driven shaft 24, in this case disposed in downward vertical orientation. The pump includes a piston guide unit 42 with conventional pistons 44 disposed within a housing 45 for alternating movement in an axial direction parallel to the axis of the motor shaft 24 upon rotary movement of a cam or oscillating plate 38 fixed to the lower end of the motor shaft 24. The operation of such axial piston pump 41 is known in the art and need not be described herein in detail.

In accordance with the invention, the motor housing includes a closure lid which defines a shaft support for the motor drive shaft, an annular seat for supporting a bearing for the pump oscillating plate, and at least one reference surface for facilitating concentric aligned mounting of the piston guide unit on the motor, without an intermediate mounting flange between the pump and motor as customary in the prior art. To this end, the illustrated motor housing includes a flange-like closure lid 10 at the lower end of the motor which defines an elongated shaft support 14 having an axial cylindrical hole 12 for supporting the motor shaft 24 for relative rotational movement. Shaft support 14 in this instance is substantially cylindrical in form and together with a side wall 17 and end wall 19 of the closure lid 10 defines a sump or chamber 50 for lubricating oil for the motor.

For providing an oil seal between the motor shaft 24 and the shaft support 14, the lower end of the shaft support 14 has a first annular seat 18 coaxial with the shaft support hole 12 defined by a circumferential surface or counterbore 20 in an enlarged cylindrical hub or end 22 of the shaft support 14. A sealing ring 26 is disposed within the annular seat 18.

For further supporting and stabilizing the motor shaft 24 and oscillating disk 38 during rotary driving movement of the shaft and disk, the closure lid 10 further defines a second annular seat 28 coaxial to the shaft support 14 within which a thrust bearing 34 is disposed. The annular seat 28 in this case is disposed downwardly and radially outwardly with respect to the first annular seat 18, being defined by radial and cylindrical walls 30, 32, respectively. The thrust bearing 34 may be of an axial or radial type, oblique, or a bearing with conical rollers.

In carrying out the invention, the piston guide unit 42 is mounted directly on the motor housing closure lid 10, without the necessity for an intermediate mounting flange, with the closure lid 10 facilitating accurate concentric support of the piston guide unit with respect to the motor shaft 24. The piston guide unit 42 in this case has radial extensions 56, such as arms or flanges, formed with mounting holes 48 which align with holes 16 in a radial mounting flange 46 of the closure lid 10 extending outwardly from the side wall 17. Bolts or like fasteners may be positioned through the holes 16, 16' to secure the pump to the motor 11 and the motor and pump, in turn, to a frame or machine with which they are to be used.

To axially locate the piston guide unit 42 on the motor closure lid 10 during mounting and to ensure proper aligned assembly during use of the hydrocleaning machine, the closure lid 10 has an integral locating and reference surface 40 which cooperates with the piston guide unit 42 in properly positioning the pump. The reference surface 40 in this instance is defined by a downwardly oriented annular projection 43 which is an integral part of the closure lid 10. The annular reference surface 40 cooperates with an inner annular surface of the piston guide unit housing 41 to position the piston guide unit in predetermined relation to the motor shaft 24. Alternatively, the guide surface may be defined by a plurality of centering feet, plug holes, or the like. In the preferred embodiment, the reference surface defining projection 43 is coaxial to the motor shaft 24 and the second annular bearing seat 28. For providing a seal between the end of the pump unit housing 41 and the closure lid 10, a toric sealing ring 54 is interposed between a flat radial surface 52 of the closure lid 10 which extends radially outwardly of the projection 43 and a mating end face of the piston guide unit housing 41. Alternatively, a conventional oil seal gasket could be used.

It will be seen that the closure lid 10 not only constitutes an integral part of the motor housing 11 by providing the motor shaft support 14 and defining the motor oil sumps 50, it further defines the seal and bearing seats 18, 28, and the piston guide unit mounting reference surface 14. The closure lid 10 with such features performs both the function of centering the piston guide unit 42, and at the same time, supporting the axial, radial and combined thrusts of the oscillating plate 38 without the need for an intermediate mounting flange. Since the reference surface 40 and the first and second annular seats 18, 28 all are coaxial to the shaft support 14, the piston guide unit may be easily centered on the closure lid 10. Moreover, the formation of the annular reference surface 40 and the seats 18, 28 does not require additional machining as they can be directly defined during casting or molding of the lid during manufacture.

Hence, a person skilled in the art will appreciate that the closure lid 10 of the motor housing 11 enables securement of the piston guide unit 42 on the motor in a quick and precise fashion without the need for an intermediate mounting flange. Elimination of the intermediate mounting flange, besides significantly reducing manufacturing costs, produces a more compact and rigid high pressure washer.

Figure 2:
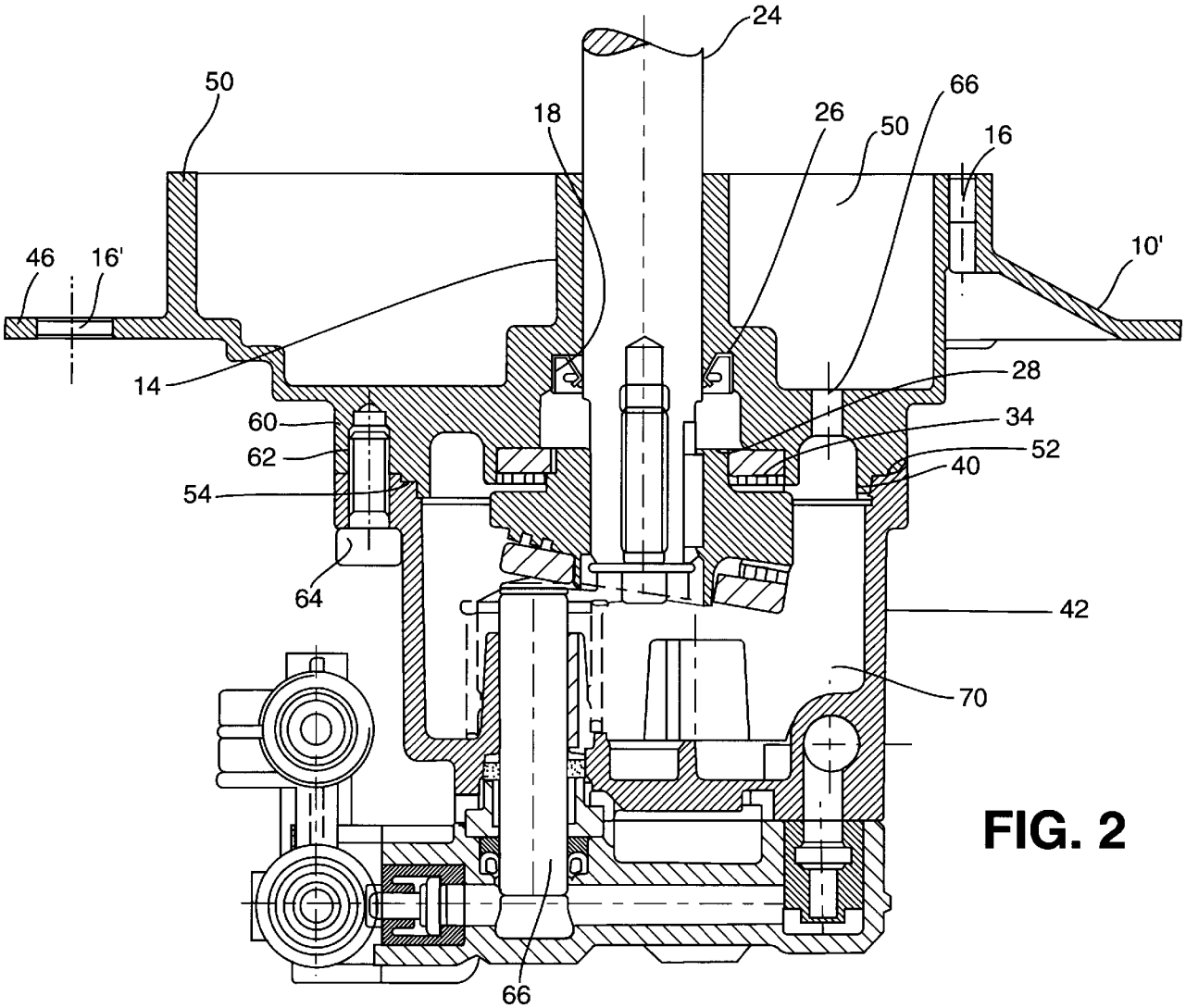
FIG. 2 is a vertical section of an alternative embodiment of hydrocleaning machine according to the present invention.

Referring now to FIG. 2, there is shown an alternative embodiment of hydrocleaning machine wherein similar items have been given similar reference numerals used in the preceding description. For securing the piston guide unit 42 to a closure lid 10' of the motor housing in this case, the closure lid 10 has an annular band or hub portion 60 radially outward of the projection 40 formed with a plurality of threaded holes 62, which in the illustrated embodiment, extend up to about the starting level of the first annular seat 18. Conventional screws 64 pass through complementary holes in the guide unit 42 and are screwed into threaded engagement with the closure lid holes 62 to securely mount the piston guide unit 42 on the closure lid 10'. The use of the mounting holes 62 in the closure lid 10 reduces the width, and consequently cost and weight, of the piston guide unit, by eliminating the mounting extensions 56 described in connection with the embodiment of FIG. 1. A further feature of the embodiment of FIG. 2 is provision of a through hole opening 66 in the closure lid 10 which connects an oil sump or chamber 50 defined by the closure lid 10' of the motor housing and a chamber 7 of the piston guide unit 42 within which the pistons 44 are axially moveable. The opening 66, which preferably is in the front wall of the closure lid 10' at a radial position between the annular seat 28 and the annular projection 40, allows the circulation of lubricating oil between the motor and the piston guide unit and in particular, permits circulating movement of the oil by the dynamics of the pistons and bergs. In this embodiment, the oil sealing ring 26 in the first annular seat 28 may be eliminated if desired.

From the foregoing, it can be seen that the hydrocleaning machine of the present invention is adapted for more economical and compact construction. By eliminating the customary intermediate mounting flange between the piston guide unit of the pump and the motor, more rigid and reliable mounting is achieved, while at the same time significantly reducing size, weight and cost. The design of the closure lid further facilitates easy and accurate coaxial mounting of the pump onto the motor.

I claim:

1. A vertically oriented hydrocleaning machine comprising:

a motor having a housing and a downwardly oriented vertical drive shaft extending outwardly from an end of said housing;

an axial pump having a piston guide unit driven by said drive shaft;

said motor housing including a closure lid at an end thereof;

said closure lid defining an oil sump for said motor, a shaft support with an axial hole through which said motor shaft extends, and an annular reference surface;

said closure lid further being formed with an axially outwardly facing annular bearing seat coaxial with said hole;

a thrust bearing disposed in said bearing seat; and said pump being mounted directly to said closure lid in coaxial aligned relation with said annular reference surface with said thrust bearing interposed between said outwardly facing bearing seat and said pump.

2. The hydrocleaning machine of claim 1 in which said reference surface is defined by an outwardly extending annular projection of said closure lid.

3. The hydrocleaning machine of claim 2 in which said closure lid includes an annular hub portion disposed radially outwardly of said annular projection, said hub portion being formed with a plurality of mounting apertures for connecting said closure lid to said pump.

4. The hydrocleaning machine of claim 3 in which said apertures extend inwardly into said flange to an axial location coinciding substantially with the axial location of said bearing seat.

5. The hydrocleaning machine of claim 2 in which said oil sump is defined by a chamber within said closure lid, said piston guide unit defining a chamber, and said closure lid being formed with at least one opening connecting between said closure lid chamber and said piston guide unit chamber.

6. The hydrocleaning machine of claim 5 in which said opening is disposed radially between said bearing seat and said annular projection.

7. The hydrocleaning machine of claim 2 including a toric ring disposed about the periphery of said reference surface between said closure lid and pump.

8. The hydrocleaning machine of claim 1 in which said shaft support is formed with an outwardly opening annular seat coaxial with said axial hole in immediately surrounding said shaft, and an oil sealing ring disposed within said shaft support annular seat in close fitting relation to said shaft.

9. The hydrocleaning machine of claim 8 in which said annular bearing seat is larger in diameter and disposed axially downwardly with respect to said shaft support annular seat.

10. The hydrocleaning machine of claim 1 in which said closure lid is formed with a plurality of mounting holes for securing the motor to a support frame.

11. The hydrocleaning machine of claim 10 in which said mounting holes are disposed radially outwardly of said reference surface.

12. A hydrocleaning machine comprising:

a motor having a housing and a drive shaft extending outwardly from an end of said housing;

an axial pump having a piston guide unit driven by said drive shaft;

said motor housing including a closure lid at an end thereof, said closure lid defining a shaft support with an axial hole through which said motor shaft extends and a reference surface in a predetermined relation to said shaft support hole; and said pump being mounted directly to said closure lid in aligned engaging relation with said reference surface.

13. The hydrocleaning machine of claim 12 in which said piston guide units has at least one piston mounted for reciprocating movement in a direction parallel to the axis of said drive shaft, a cam plate fixed to the end of said drive shaft for reciprocating said piston in response to rotational driving movement of said drive shaft and cam plate, and the closure lid being formed with an annular bearing seat coaxial with said drive shaft, and a bearing disposed within said annular seat for stabilizing rotational movement of said shaft and cam plate.

14. The hydrocleaning machine of claim 13 in which said further annular seat is disposed radially inwardly with respect to said bearing seat.

15. The hydrocleaning machine of claim 13 in which said bearing is a thrust bearing disposed within said bearing seat in interposed relation between said closure lid and cam plate.

16. The hydrocleaning machine of claim 12 in which said closure lid defines an oil sump communicating internally within said motor.

17. The hydrocleaning machine of claim 16 in which said piston guide unit has a housing which defines an oil chamber, and said closure lid is formed with at least one opening communicating between said motor oil sump and said piston guide unit oil chamber.

18. The hydrocleaning machine of claim 12 in which said alignment surface is defined by an annular outwardly extending projection of the closure lid.

19. The hydrocleaning machine of claim 12 in which said shaft support is an elongated substantially cylindrical member coaxial with said motor shaft.

20. The hydrocleaning machine of claim 12 in which said closure lid has a flange with a mounting aperture for mounting said motor on a frame.

21. The hydrocleaning machine of claim 20 in which said piston guide unit has a housing with a flange formed with a mounting aperture positionable in coaxial alignment with said closure lid mounting aperture when said closure lid reference surface is in aligned engaging relation with said piston guide unit.

22. The hydrocleaning machine of claim 20 in which said piston unit and closure lid are formed with aligned securement apertures when said closure lid reference surface is in aligned engaging relation with said piston guide unit for enabling securement of said piston guide unit to said closure lid, said securement apertures being located radially inwardly of said closure lid mounting apertures.

23. The hydrocleaning machine of claim 12 in which said closure lid is formed with a further annular seat, and a sealing ring is mounted in said further annular seat in sealing contact with said motor shaft.

* * * * *